US007901204B2

(12) United States Patent
Stephens et al.

(10) Patent No.: US 7,901,204 B2
(45) Date of Patent: Mar. 8, 2011

(54) DUAL FUEL GAS-LIQUID BURNER

(75) Inventors: George Stephens, Humble, TX (US); David Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1235 days.

(21) Appl. No.: 11/338,333

(22) Filed: Jan. 24, 2006

(65) Prior Publication Data

US 2007/0172784 A1 Jul. 26, 2007

(51) Int. Cl.
*F23C 5/00* (2006.01)

(52) U.S. Cl. ..... 431/174; 431/2; 431/4; 431/8; 431/9; 431/162; 431/175; 431/177

(58) Field of Classification Search ..... 431/2, 4, 431/9, 162, 174, 175
See application file for complete search history.

(56) References Cited

U.S. PATENT DOCUMENTS

| | | | | |
|---|---|---|---|---|
| 2,344,203 | A | 3/1944 | Creighton | |
| 2,407,973 | A * | 9/1946 | Beckstrom | 431/254 |
| 2,412,579 | A | 12/1946 | Hauzvic | |
| 2,515,494 | A | 7/1950 | Checkon | |
| 2,813,578 | A | 11/1957 | Ferguson | |
| 2,918,117 | A | 12/1959 | Griffin | |
| 2,957,755 | A * | 10/1960 | Warner | 423/456 |
| 3,003,854 | A * | 10/1961 | Heller | 423/450 |
| 3,078,084 | A | 2/1963 | Foresi et al. | |
| 3,236,280 | A | 2/1966 | Greinke | |
| 3,242,966 | A | 3/1966 | Eisentrout | |
| 3,361,183 | A * | 1/1968 | Reichhelm | 431/116 |
| 3,376,098 | A | 4/1968 | Pryor | |
| 3,529,915 | A * | 9/1970 | Sakai et al. | 431/284 |
| 3,531,050 | A * | 9/1970 | Abraham et al. | 239/427.3 |
| 3,615,242 | A | 10/1971 | Anderson et al. | |
| 3,797,992 | A | 3/1974 | Straitz, III | |
| 3,822,654 | A * | 7/1974 | Ghelfi | 110/260 |
| 3,828,700 | A * | 8/1974 | Ragot | 110/238 |
| 3,847,714 | A * | 11/1974 | Davies et al. | 159/4.02 |
| 3,881,430 | A | 5/1975 | Katz | |
| 3,922,335 | A | 11/1975 | Jordan et al. | |
| 3,985,494 | A | 10/1976 | Childree | |
| 4,044,549 | A * | 8/1977 | Zwick | 60/772 |
| 4,094,625 | A * | 6/1978 | Wang et al. | 431/9 |

(Continued)

FOREIGN PATENT DOCUMENTS

DE 2 223 631 11/1973

(Continued)

*Primary Examiner* — Kenneth B Rinehart
*Assistant Examiner* — Jorge Pereiro

(57) ABSTRACT

A dual-fuel burner for use in furnaces such as in steam cracking. The burner includes a primary air chamber, a burner tube having an upstream end and a downstream end, a fuel orifice located adjacent the upstream end of the burner tube for introducing gaseous fuel into the burner tube, a burner tip having an outer diameter mounted on the downstream end of the burner tube adjacent a first opening in the furnace, so that combustion of the gaseous fuel takes place downstream of the burner tip, and at least one non-gaseous fuel gun, the at least one non-gaseous fuel gun having at least one fuel discharge orifice for combusting the non-gaseous fuel downstream of the discharge orifice, wherein the at least one non-gaseous fuel gun is radially positioned beyond the outer diameter of the burner tip so that a flame emanating from the combustion of the non-gaseous fuel is substantially aligned in parallel with a flame emanating from the combustion of the gaseous fuel.

32 Claims, 4 Drawing Sheets

U.S. PATENT DOCUMENTS 4,134,719 A 1/1979 Velie
4,138,842 A * 2/1979 Zwick ..... 60/39.23
4,171,612 A * 10/1979 Zwick ..... 60/39.23
4,230,445 A 10/1980 Janssen ..... 431/116
4,257,763 A 3/1981 Reed
4,347,052 A * 8/1982 Reed et al. ..... 431/188
4,348,168 A 9/1982 Coulon
4,425,856 A * 1/1984 Szilagyi ..... 110/346
4,463,568 A 8/1984 Willis et al.
4,475,466 A * 10/1984 Gravely ..... 588/321
4,480,986 A * 11/1984 Nelson et al. ..... 431/37
4,496,306 A 1/1985 Okigami et al.
4,505,666 A 3/1985 Martin et al.
4,544,350 A * 10/1985 Ware et al. ..... 431/285
4,575,332 A 3/1986 Oppenberg et al. ..... 431/9
4,629,413 A 12/1986 Michelson et al. ..... 431/9
4,708,638 A * 11/1987 Brazier et al. ..... 431/116
4,815,966 A 3/1989 Janssen
4,830,604 A 5/1989 Korenberg
4,836,772 A * 6/1989 LaRue ..... 431/285
4,860,695 A 8/1989 Korenberg
4,915,619 A * 4/1990 LaRue ..... 431/284
5,044,559 A * 9/1991 Russell et al. ..... 239/406
5,044,932 A 9/1991 Martin et al.
5,073,105 A 12/1991 Martin et al.
5,092,761 A 3/1992 Dinicolantonio ..... 431/115
5,098,282 A 3/1992 Schwartz et al.
5,147,199 A * 9/1992 Perthuis et al. ..... 431/10
5,149,363 A 9/1992 Contrucci et al.
5,180,302 A 1/1993 Schwartz et al.
5,195,884 A 3/1993 Schwartz et al.
5,238,395 A 8/1993 Schwartz et al.
5,245,937 A 9/1993 Nakase et al.
5,275,552 A 1/1994 Schwartz et al.
5,275,554 A * 1/1994 Faulkner ..... 431/115
5,284,438 A 2/1994 McGill et al.
5,299,929 A * 4/1994 Yap ..... 431/8
5,383,782 A * 1/1995 Yap ..... 432/22
5,403,181 A 4/1995 Tanaka et al.
5,449,288 A * 9/1995 Bass ..... 431/330
5,516,279 A 5/1996 Yap ..... 431/175
5,542,840 A * 8/1996 Surbey et al. ..... 431/116
5,573,391 A 11/1996 Benson et al.
5,636,977 A 6/1997 Benson et al.
5,681,160 A * 10/1997 Ellis et al. ..... 431/202
5,735,468 A * 4/1998 Casey ..... 239/425
5,823,762 A * 10/1998 Anderson et al. ..... 431/8
5,984,665 A 11/1999 Loftus et al.
5,993,193 A 11/1999 Loftus et al.
6,007,325 A 12/1999 Loftus et al.
6,012,915 A * 1/2000 Mori et al. ..... 431/4
6,041,743 A * 3/2000 Takubo et al. ..... 122/367.3
6,099,818 A * 8/2000 Freund et al. ..... 423/449.1
6,174,160 B1 * 1/2001 Lee et al. ..... 431/11
6,234,092 B1 * 5/2001 Domschke et al. ..... 110/238
6,342,086 B1 1/2002 Shver
6,350,116 B1 * 2/2002 Herrmann ..... 431/208
6,394,792 B1 5/2002 McDonald et al.
6,397,602 B2 * 6/2002 Vandervort et al. ..... 60/737
6,402,059 B1 6/2002 Benz et al.
6,422,858 B1 7/2002 Chung et al.
6,499,990 B1 12/2002 Zink et al.
6,598,383 B1 * 7/2003 Vandervort et al. ..... 60/773
6,616,442 B2 9/2003 Venizelos et al.
6,632,084 B2 10/2003 Berenbrink
6,663,380 B2 12/2003 Rabovitser et al.
6,672,859 B1 1/2004 Rabovitser et al.
6,773,256 B2 8/2004 Joshi et al.
6,877,980 B2 4/2005 Stephens et al. ..... 431/115
6,893,251 B2 * 5/2005 Stephens ..... 431/9
7,243,496 B2 7/2007 Pavlik et al.
7,506,510 B2 3/2009 Thomson
7,670,135 B1 3/2010 Zink et al.
2001/0004827 A1 * 6/2001 Vandervort et al. ..... 60/39.55
2001/0049076 A1 12/2001 Schindler et al.
2003/0175635 A1 * 9/2003 Stephens et al. ..... 431/9
2004/0018461 A1 * 1/2004 Stephens et al. ..... 431/115
2009/0274985 A1 11/2009 Mcknight et al.

FOREIGN PATENT DOCUMENTS

DE 4306980 9/1994
EP 0 304 879 3/1989
EP 0 626 538 11/1994
JP 58 024706 2/1983
NL 1011814 12/2000

* cited by examiner

DUAL FUEL GAS-LIQUID BURNER

FIELD OF THE INVENTION

This invention relates to an improvement in a burner such as those employed in high temperature furnaces in the steam cracking of hydrocarbons. More particularly, it relates to an improved dual fuel (gas/non-gaseous) burner capable of providing good combustion efficiency, stable combustion and low soot production.

BACKGROUND OF THE INVENTION

Steam cracking has long been used to crack various hydrocarbon feedstocks into olefins, preferably light olefins such as ethylene, propylene, and butenes. Conventional steam cracking utilizes a furnace which has two main sections: a convection section and a radiant section. The hydrocarbon feedstock typically enters the convection section of the furnace as a liquid or gas wherein it is typically heated and vaporized by indirect contact with hot flue gas from the radiant section and by direct contact with steam. The vaporized feedstock and steam mixture is then introduced into the radiant section where the cracking takes place.

Conventional steam cracking systems have been effective for cracking high-quality feedstock which contains a large fraction of light volatile hydrocarbons, such as naphtha. However, steam cracking economics sometimes favor cracking lower cost feedstocks containing resids such as, atmospheric resid and crude oil. Crude oil and atmospheric resid often contain high molecular weight, non-volatile components with boiling points in excess of 590° C. (1100° F.). There are other feeds, such as gas-oils and vacuum gas-oils, that produce large amounts of tar and are also problematic for conventional steam cracking systems. Cracking heavier feeds produces large amounts of tar.

In conventional chemical manufacturing processes, steam cracker tar is typically an undesired side product. When large volumes of low value steam cracker tar are produced, the refiner is placed in the position of blending the tar into heavy fuels or other low value products. Alternatively, steam cracker tar can be used as a fuel within the refinery; however, its physical and chemical properties make it extremely difficult to burn cleanly and efficiently.

Burners used in large industrial furnaces typically use either liquid or gaseous fuel. Liquid fuel burners typically mix the fuel with steam prior to combustion to atomize the fuel to enable more complete combustion, and mix combustion air with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, such that the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. As such, the premix burner is the burner of choice for such furnaces. Premix burners can also be designed for special heat distribution profiles or flame shapes required in other types of furnaces.

The majority of recent burner designs for gas-fired industrial furnaces are based on the use of multiple fuel jets in a single burner. Such burners may employ fuel staging, flue-gas recirculation, or a combination of both. Certain burners may have as many as 8-12 fuel nozzles in a single burner. The large number of fuel nozzles requires the use of very small diameter nozzles. In addition, the fuel nozzles of such burners are generally exposed to the high temperature flue-gas in the firebox.

Because of the interest in recent years to reduce the emission of pollutants and improve the efficiency of burners used in large furnaces and boilers, significant improvements have been made in burner design. One technique for reducing emissions that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. Combustion staging results in reducing peak temperatures in the primary flame zone and has been found to alter combustion speed in a way that reduces $NO_x$. However this must be balanced with the fact that radiant heat transfer decreases with reduced flame temperature, while CO emissions, an indication of incomplete combustion, may actually increase.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air is more remotely associated with the fuel. The upper limit of flammability refers to the mixture containing the maximum fuel concentration (fuel-rich) through which a flame can propagate.

U.S. Pat. No. 2,813,578, the contents of which are incorporated by reference in their entirety, proposes a heavy liquid fuel burner, which mixes the fuel with steam for inspiration prior to combustion. The inspirating effect of the fuel and steam draws hot furnace gases into a duct and into the burner block to aid in heating the burner block and the fuel and steam passing through a bore in the block. This arrangement is said to be effective to vaporize liquid fuel and reduce coke deposits on the burner block and also to prevent any dripping of the oil.

U.S. Pat. No. 2,918,117 proposes a heavy liquid fuel burner, which includes a venturi to draw products of combustion into the primary air to heat the incoming air stream to therefore completely vaporize the fuel.

U.S. Pat. No. 4,230,445, the contents of which are incorporated by reference in their entirety, proposes a fluid fuel burner that reduces $NO_x$ emissions by supplying a flue gas/air mixture through several passages. Flue gas is drawn from the combustion chamber through the use of a blower.

U.S. Pat. No. 4,575,332, the contents of which are incorporated by reference in their entirety, proposes a burner having both oil and gas burner lances, in which $NO_x$, emissions are reduced by discontinuously mixing combustion air into the oil or gas flame to decelerate combustion and lower the temperature of the flame.

U.S. Pat. No. 4,629,413 proposes a low $NO_x$ premix burner and discusses the advantages of premix burners and methods to reduce $NO_x$ emissions. The premix burner of U.S. Pat. No. 4,629,413 is said to lower $NO_x$ emissions by delaying the mixing of secondary air with the flame and allowing some cooled flue gas to recirculate with the secondary air. The contents of U.S. Pat. No. 4,629,413 are incorporated by reference in their entirety.

U.S. Pat. No. 5,092,761 proposes a method and apparatus for reducing $NO_x$ emissions from premix burners by recirculating flue gas. Flue gas is drawn from the furnace through recycle ducts by the inspirating effect of fuel gas and combustion air passing through a venturi portion of a burner tube. Airflow into the primary air chamber is controlled by dampers and, if the dampers are partially closed, the reduction in pressure in the chamber allows flue gas to be drawn from the furnace through the recycle ducts and into the primary air chamber. The flue gas then mixes with combustion air in the primary air chamber prior to combustion to dilute the concentration of oxygen in the combustion air, which lowers flame temperature and thereby reduces $NO_x$, emissions. The flue gas recirculating system may be retrofitted into existing burners or may be incorporated in new low $NO_x$ burners. The entire contents of U.S. Pat. No. 5,092,761 are incorporated herein by reference.

U.S. Pat. No. 5,516,279 proposes an oxy-fuel burner system for alternately or simultaneously burning gaseous and liquid fuels. Proposed therein is the use of a gaseous fuel jet emanating from an oxy-fuel burner that is either undershot by an oxygen lance or is sandwiched between oxidant jets produced by two subsidiary oxidant jets which are preferably formed of oxygen. An actuable second fuel nozzle is proposed for producing a second fuel jet composed of liquid fuel which is angled toward the oxidant jet at an angle of less than 20°. When liquid fuel is to be used, it is proposed that the gaseous fuel be turned off and the liquid fuel turned on and vice-versa or both can operate simultaneously where the oxidant supplies oxygen to both fuel streams.

U.S. Pat. No. 6,877,980, the contents of which are hereby incorporated by reference for all that they disclose, proposes a burner for use in furnaces, such as in steam cracking. The burner includes a primary air chamber; a burner tube having an upstream end, a downstream end and a venturi intermediate said upstream and downstream ends, said venturi including a throat portion having substantially constant internal cross-sectional dimensions such that the ratio of the length to maximum internal cross-sectional dimension of said throat portion is at least 3, a burner tip mounted on the downstream end of said burner tube adjacent a first opening in the furnace, so that combustion of the fuel takes place downstream of said burner tip and a fuel orifice located adjacent the upstream end of said burner tube, for introducing fuel into said burner tube.

Notwithstanding the widespread use of single fuel burners, there has been considerable interest in dual fuel burners which use both gas and liquid fuels simultaneously. Various benefits can be obtained through the use of a dual fuel implementation. For example, these burners can be designed, in many cases, to permit either dual fuel combustion or gas only combustion and thus provide flexibility in fuel selection. The conventional wisdom when designing dual fuel burners is to supply a large amount of air to the liquid fuel flame in an effort to achieve efficient combustion with minimal carbon and soot production. It is also typical for these burners to have a completely separate gas and liquid flame because it is thought that the gaseous flame has such a high combustion rate that it will use up most of the oxygen and thus deprive the liquid fuel of the oxygen that it needs to provide efficient combustion.

As may be appreciated, one possible fuel for use in a dual fuel burner is steamcracker tar. Steamcracker tar typically has a very low ash content which helps to minimize the amount of particulates ultimately emitted from the flame. However, there are concerns when steamcracker tar is burned in a conventional dual fuel burner particularly in an overly air-rich environment.

First, if too much air is used, the combustion temperature in the burner can become too low. In this event, the combustion efficiency decreases and the carbon production of the burner will increase. Second, flame stability can become an issue in that the flame may oscillate between complete or nearly complete combustion to severely incomplete combustion. As a result of incomplete combustion, a significant amount of soot will be produced by the burner.

Despite these advances in the art, what is needed is a dual fired gaseous/non-gaseous burner which permits flexibility in fuel selection and which has good combustion efficiency, has a stable flame and has low soot production characteristics.

SUMMARY OF THE INVENTION

The present invention is directed to a dual fuel gas/non-gaseous burner, which may be used in furnaces such as those employed in steam cracking. The burner includes a primary air chamber, a burner tube having an upstream end and a downstream end, a fuel orifice located adjacent the upstream end of the burner tube, for introducing gaseous fuel into the burner tube, a burner tip having an outer diameter mounted on the downstream end of the burner tube adjacent a first opening in the furnace, so that combustion of the gaseous fuel takes place downstream of the burner tip, at least one non-gaseous fuel gun, the at least one non-gaseous fuel gun having at least one fuel discharge orifice for combusting the non-gaseous fuel downstream of the discharge orifice, wherein the at least one non-gaseous fuel gun is radially positioned beyond the outer diameter of the burner tip so that a flame emanating from the combustion of the non-gaseous fuel is substantially aligned in parallel with a flame emanating from the combustion of the gaseous fuel.

In another aspect, provided is a method for combusting a non-gaseous fuel and a gaseous fuel within a burner of a furnace. The method includes the steps of: combining the gaseous fuel and air at a predetermined location; combusting the gaseous fuel at a first combustion point downstream of said predetermined location to produce a gaseous fuel flame; providing the non-gaseous fuel to at least one fuel discharge orifice; combusting the non-gaseous fuel downstream of the discharge orifice at a second combustion point to produce a non-gaseous fuel flame; and exchanging heat between the gaseous fuel flame and a portion of the non-gaseous fuel to enhance non-gaseous fuel vaporization and stabilize non-gaseous fuel combustion; wherein the non-gaseous fuel is provided so as to be radially positioned beyond the first point of combustion so that a flame emanating from the combustion of the non-gaseous fuel is substantially aligned in parallel with a flame emanating from the combustion of the gaseous fuel.

The burners disclosed herein provide a burner arrangement with good flame stability, low soot production and good combustion efficiency.

The several features of the burners disclosed herein will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF PREFERRED EMBODIMENTS

Figure 1:
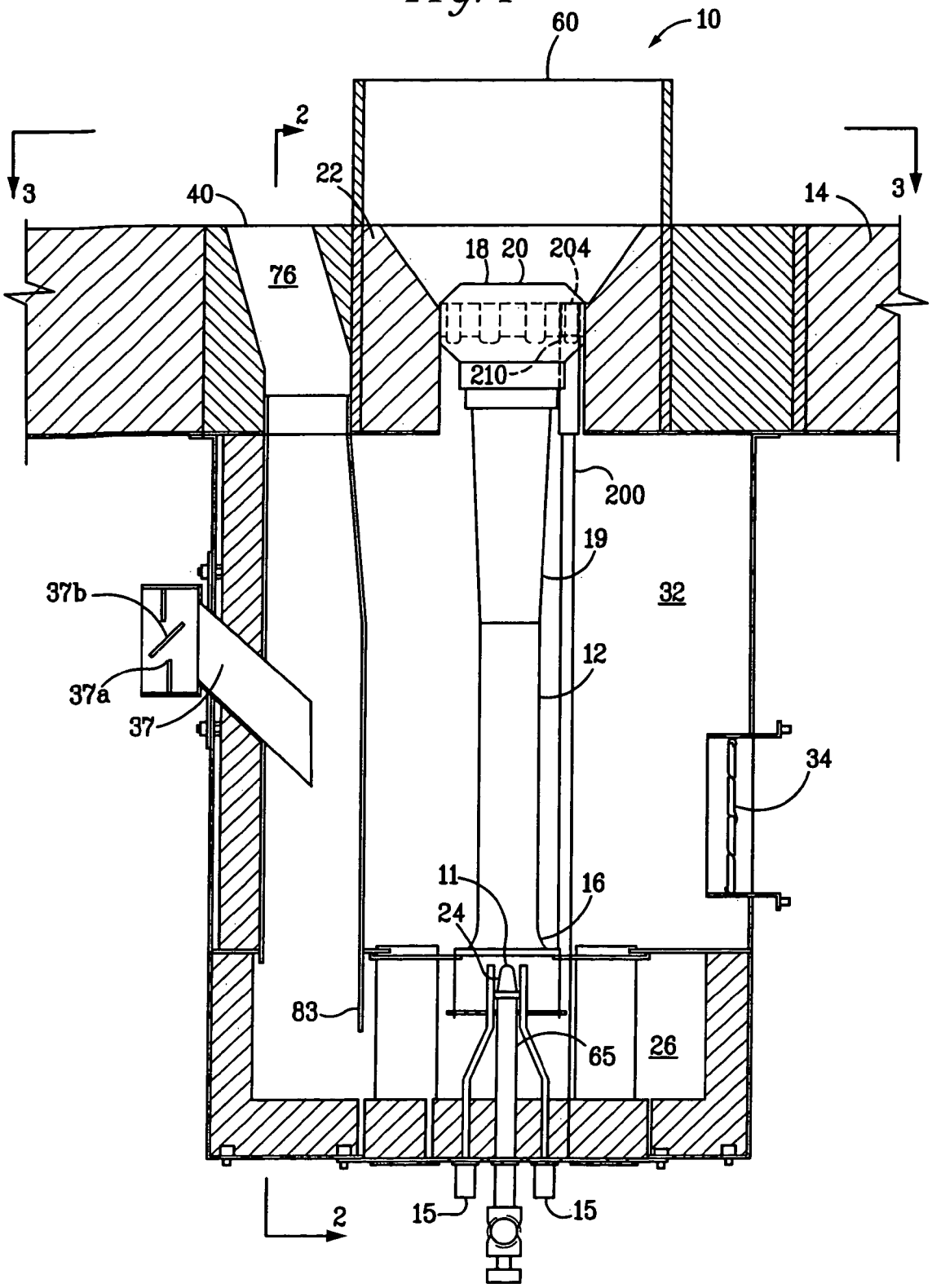
FIG. 1 illustrates an elevation partly in section of the burner of the present invention.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIGS. 1-4, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A gas fuel orifice 11, which may be located within gas fuel spud 24, is located at the top end of a gas fuel riser 65 and is located at the upstream end 16 of burner tube 12 and introduces gas fuel into the burner tube 12. Fresh or ambient air is introduced into a primary air chamber 26 through an adjustable damper 37*b* to mix with the gas fuel at the upstream end 16 of the burner tube 12 and pass upwardly through the venturi portion 19. Combustion of the fuel and fresh air occurs downstream of the burner tip 20.

Figure 2:
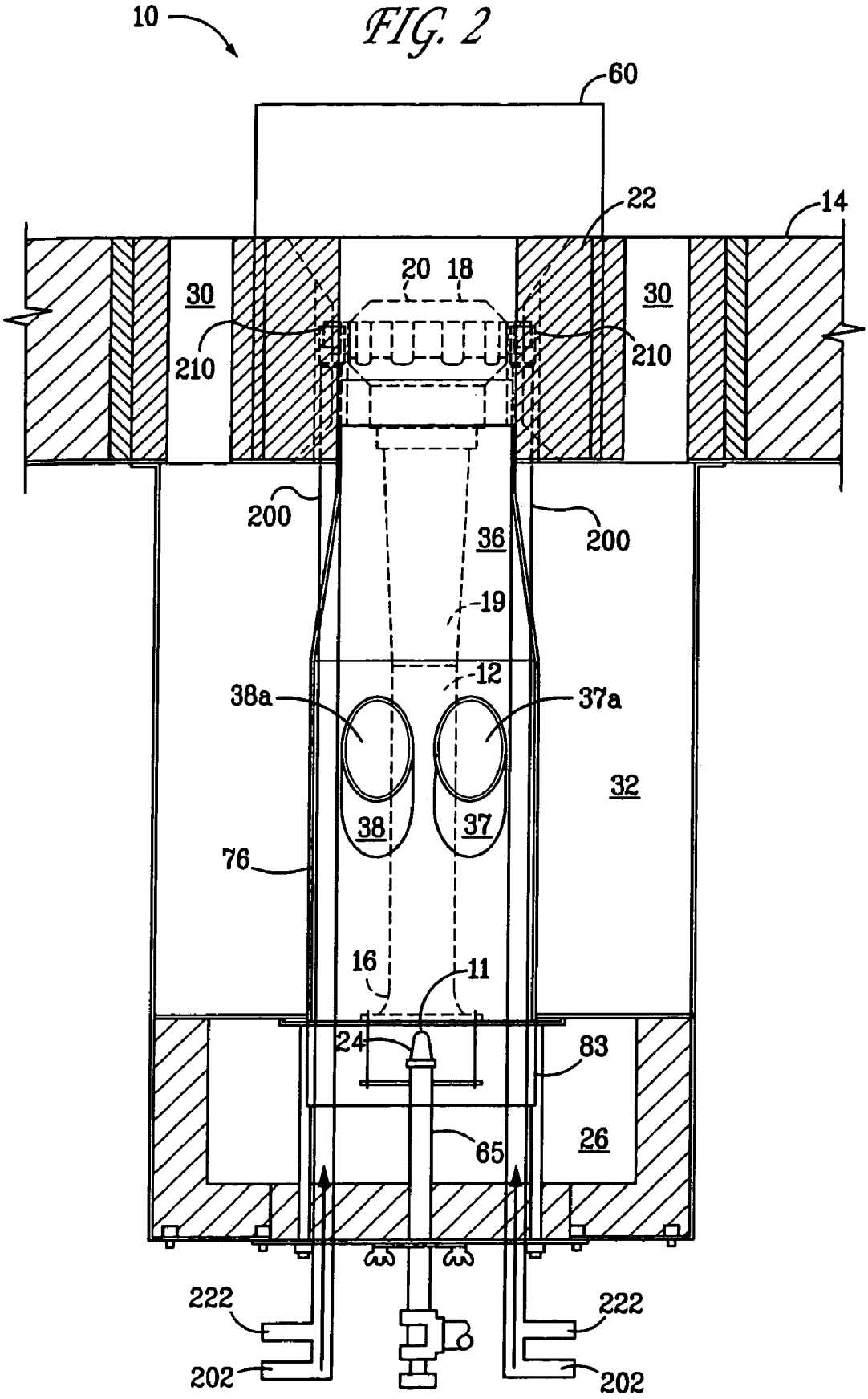
FIG. 2 is an elevation partly in section taken along line 2-2 of FIG. 1.
Figure 3:
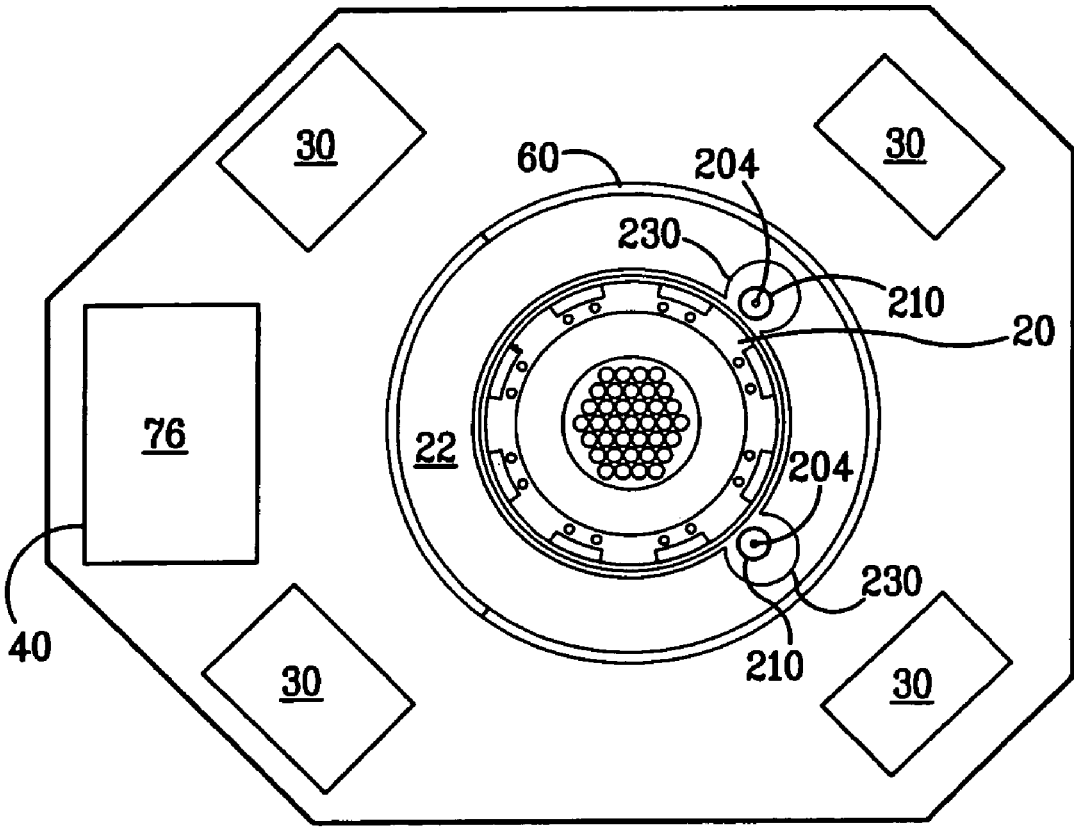
FIG. 3 is a plan view taken along line 3-3 of FIG. 1.

As shown in FIGS. 1, 2 and 3, a plurality of staged air ports 30 originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion.

In addition to the gas fuel supplied through gas fuel spud 24 and combusted at burner tip 20, non-gaseous fuel may also be combusted by burner 10. To provide this capability, one or more non-gaseous fuel guns 200 are positioned within annular tile 22 of burner 10. Suitable sources of non-gaseous fuel include, by way of example, but not of limitation, steam-cracker tar, catalytic cracker bottoms, vacuum resids, atmospheric resids, deasphalted oils, resins, coker oils, heavy gas oils, shale oils, tar sands or syncrude derived from tar sands, distillation resids, coal oils, asphaltenes and other heavy petroleum fractions. Other fuels which may be of interest include pyrolysis fuel oil (PFO), virgin naphthas, cat-naphtha, steam-cracked naphtha, and pentane.

Figure 4:
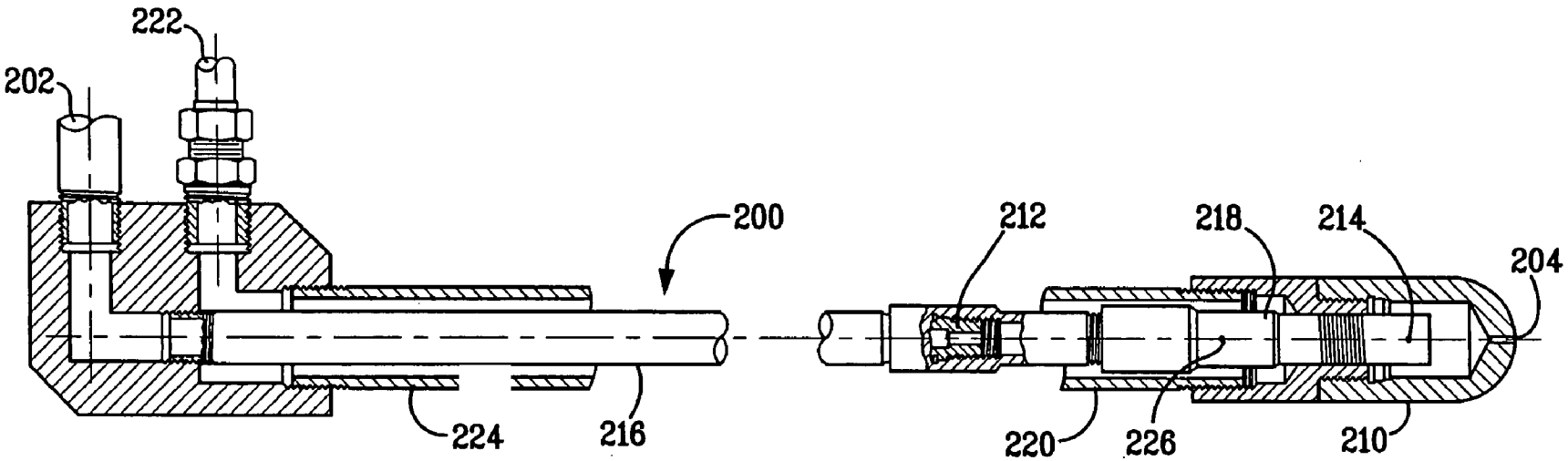
FIG. 4 is a view in cross-section of a fuel gun for use in the burner of the present invention.

Referring to FIG. 4, each non-gaseous fuel gun 200 may be fed by a non-gaseous fuel line 216, through which non-gaseous fuel flows. A non-gaseous fuel spud 212 having an orifice (not shown) is provided to assist in the control of the non-gaseous fuel flow rate. Non-gaseous fuel is supplied to each non-gaseous fuel line 216 via a non-gaseous fuel inlet 202 which is preferably located below the floor of the furnace, as shown in FIG. 2.

As will become more apparent, the burner of the present invention may operate using only gaseous fuel or using both gaseous and non-gaseous fuel simultaneously. When operating in a dual fuel (gaseous/non-gaseous) mode, the burner may be designed and set so that combustion of the non-gaseous fuel produces from about 0 to about 50% of the overall burner's heat release. Further, the burner may be designed and set so that combustion of the non-gaseous fuel produces from about 0 to about 37% of the burner's heat release. Still yet further, the burner may be designed and set so that combustion of the non-gaseous fuel produces from about 0 to about 25% of the burner's heat release. When operating in a dual fuel mode wherein combustion of the non-gaseous fuel produces about 50% of the overall burner's heat release, it has been found that temperatures at the burner floor may approach levels that are undesirably high.

Referring again to FIG. 4, in accordance with a preferred form of the invention, the non-gaseous fuel is atomized upon exit from the one or more non-gaseous fuel guns 200. A fluid atomizer 220 is provided to atomize the non-gaseous fuel. A fluid, such as steam, enters atomizer line 224 through inlet 222. The atomizer includes a plurality of pressure jet orifices 226, through which is provided the atomizing fluid. The atomizer fluid and fuel mix within section 218 and issue through a plurality of orifices 214. The atomizing fluid and non-gaseous fuel discharge through tip section 210 through at least one fuel discharge orifice 204. Suitable fuel guns of the type depicted may be obtained commercially from Callidus Technologies, LLC, of Tulsa, Okla., with other acceptable versions obtainable from other industrial sources.

Various embodiments of the present invention are possible. In one embodiment, the at least one fuel discharge orifice 204 of non-gaseous fuel discharge tip section 210 may be a single orifice, positioned so as to be parallel with the centerline of the gas flame and the extended centerline of the burner tube 12. In an alternate embodiment, it is particularly desirable to configure the at least one non-gaseous discharge orifice 204 of the at least one non-gaseous fuel gun 200 so that the non-gaseous fuel is injected parallel to the extended centerline of the burner tube 12 and, optionally, tangential to the gaseous fuel flame prior to combustion. Discharging the non-gaseous fuel in close proximity to the high temperature gas flame advantageously permits the non-gaseous fuel to become well vaporized and stabilized by the intense gas-fuel flame located in close proximity to it, permitting stable and efficient non-gaseous-fuel combustion. This will also tend to reduce soot production. As a result, the problems typically associated with incomplete combustion are minimized or even eliminated.

Referring again to FIG. 3, air flows through air gaps 230. The amount of air for the non-gaseous-fueled flame can vary from sub-stoichiometric to super-stoichiometric by changing the air gap 230 around the non-gaseous burner tip and by adjusting the air rate into the burner secondary burner box. Each gap 230 between peripheral tile 22 and each non-gaseous fuel gun 200 may advantageously be sized so that the air inflow is controlled so as to prevent incoming air from delaying vaporization of the non-gaseous fuel. As a result, the problems typically associated with incomplete combustion are eliminated. The burner of the present invention may operate using only gas fuel or using both gas and non-gaseous fuel simultaneously.

Referring again to FIGS. 1 through 3, an optional embodiment of the invention, flue gas recirculation, may also be employed along with the dual fuel implementation. In order to recirculate flue gas from the furnace to the primary air chamber, FGR duct 76 extends from opening 40, in the floor of the furnace into the primary air chamber 26. Alternatively, multiple passageways (not shown) may be used instead of a single passageway. Flue gas is drawn through FGR duct 76 by the inspirating effect of gas fuel passing through venturi 19 of burner tube 12. In this manner, the primary air and flue gas are mixed in primary air chamber 26, which is prior to the zone of combustion. Therefore, the amount of inert material mixed with the fuel is raised, thereby reducing the flame temperature, and as a result, reducing $NO_x$ emissions. Closing or partially closing damper 37*b* restricts the amount of fresh air that can be drawn into the primary air chamber 26 and thereby provides the vacuum necessary to draw flue gas from the furnace floor.

Optionally, mixing may be promoted by providing two or more primary air channels 37 and 38 protruding into the FGR duct 76. The channels 37 and 38 are conic-section, cylindrical, or squared and a gap between each channel 37 and 38 produces a turbulence zone in the FGR duct 76 where good flue gas/air mixing occurs.

The geometry of channels 37 and 38 is designed to promote mixing by increasing air momentum into the FGR duct 76. The velocity of the air is optimized by reducing the total flow area of the primary air channels 37 and 38 to a level that still permits sufficient primary air to be available for combustion, as those skilled in the art are capable of determining through routine trials.

Mixing may be further enhanced by providing a plate member 83 at the lower end of the inner wall of the FGR duct 76. The plate member 83 extends into the primary air chamber 26. Flow eddies are created by flow around the plate of the mixture of flue gas and air. The flow eddies provide further mixing of the flue gas and air. The plate member 83 also makes the FGR duct 76 effectively longer, and a longer FGR duct also promotes better mixing.

The improvement in the amount of mixing between the recirculated flue gas and the primary air caused by the channels 37 and 38 and the plate member 83 results in a higher capacity of the bumer to inspirate flue gas recirculation and a more homogeneous mixture inside the venturi portion 19. Higher flue gas recirculation reduces overall flame temperature by providing a heat sink for the energy released from combustion. Better mixing in the venturi portion 19 tends to reduce the hot-spots that occur as a result of localized high oxygen regions.

Unmixed low temperature ambient air. (primary air), is introduced through angled channels 37 and 38, each having a first end comprising an orifice 37*a* and 38*a*, controlled by damper 37*b*, and a second end comprising an orifice which communicates with FGR duct 76. The ambient air so introduced is mixed directly with the recirculated flue gas in FGR duct 76. The primary air is drawn through channels 37 and 38, by the inspirating effect of the gas fuel passing through the fuel orifice, which may be contained within gas spud 24. The ambient air may be fresh air as discussed above.

Advantageously, a mixture of from about 20% to about 80% flue gas and from about 20% to about 80% ambient air should be drawn through FGR duct 76. It is particularly preferred that a mixture of about 50% flue gas and about 50% ambient air be employed.

In operation, fuel orifice 11, which may be located within gas spud 24, discharges gas fuel into burner tube 12, where it mixes with primary air, recirculated flue gas or mixtures thereof. The mixture of fuel, recirculated flue-gas and primary air then discharges from burner tip 20. The mixture in the venturi portion 19 of burner tube 12 is maintained below the fuel-rich flammability limit; i.e. there is insufficient air in the venturi to support combustion. Secondary air is added to provide the remainder of the air required for combustion.

The cross-section of FGR duct 76 may be designed so as to be substantially rectangular, typically with its minor dimension ranging from 30% to 100% of its major dimension. Conveniently, the cross sectional area of FGR duct 76 ranges from about 5 square inches to about 12 square inches/million (MM) Btu/hr burner capacity and, in a practical embodiment, from 34 square inches to 60 square inches. In this way the FGR duct 76 can accommodate a mass flow rate of at least 100 pounds per hour per MM Btu/hr burner capacity, preferably at least 130 pounds per hour per MM Btu/hr burner capacity, and still more preferably at least 200 pounds per hour per MM Btu/hr burner capacity. Moreover, FGR ratios of greater than 10% and up to 15% or even up to 20% can be achieved.

With reference to FIGS. 1 through 3, another optional embodiment will be described. A wall 60 is provided to encircle the burner tip 20 mounted on the downstream end 18 of the burner tube 12 to provide a barrier between a base of a flame downstream of the burner tip 20 and both FGR duct 76 in the furnace and one or more air ports 30. As may be appreciated, by reference to FIG. 3, each fuel gun 200 will lie within the area encompassed by wall 60, wall 60 further serving to stabilize each flame. Either configuration is capable of providing excellent performance.

Advantageously, the burner disclosed herein may be operated at about 2% oxygen in the flue gas (about 10 to about 12% excess air). In addition to the use of flue gas as a diluent, another technique to achieve lower flame temperature through dilution is by the use of steam injection. Steam can be injected in the primary air or the secondary air chamber. Steam may be injected through one or more steam injection tubes 15, as shown in FIG. 1. Preferably, steam is injected upstream of the venturi.

Although the invention has been described with reference to particular means, materials and embodiments, it is to be understood that the invention is not limited to the particulars disclosed and extends to all equivalents within the scope of the claims.

What is claimed is:

1. A staged-air dual-fuel burner for the combustion of gaseous and non-gaseous fuels in a furnace, said burner comprising:

(a) a primary air chamber for supplying a first portion of air;

(b) a burner tube having an upstream end and a downstream end;

(c) a fuel orifice located adjacent the upstream end of said burner tube, for introducing gaseous fuel into said burner tube;

(d) a burner tip having an outer diameter mounted on said downstream end of said burner tube adjacent a first opening in the furnace, so that combustion of the gaseous fuel takes place downstream of said burner tip;

(e) at least one non-gaseous fuel gun, said at least one non-gaseous fuel gun having at least one fuel discharge orifice for combusting the non-gaseous fuel downstream of said discharge orifice; and (f) at least one air port in fluid communication with a secondary air chamber for supplying a second portion of fresh or ambient air;

(g) a peripheral tile which peripherally surrounds said burner tip, said peripheral tile having at least one radially disposed opening for placement of said at least one non-gaseous fuel gun within said openings of said peripheral tile;

wherein said at least one non-gaseous fuel gun is radially positioned beyond said outer diameter of said burner tip so that a flame emanating from the combustion of the non-gaseous fuel is substantially aligned in parallel with a flame emanating from the combustion of the gaseous fuel;

wherein each opening of said peripheral tile is sized to provide a gap between said peripheral tile and each said non-gaseous fuel gun effective for providing a portion of the air for combustion of the non-gaseous fuel, and each said gap between said peripheral tile and each said non-gaseous fuel gun is sized so that the air inflow is controlled so as to prevent incoming air from delaying vaporization of the non-gaseous fuel.

2. The burner of claim 1, wherein each of said at least one non-gaseous fuel guns is supplied by a non-gaseous fuel stream and an atomizing stream, the atomizing stream sufficient to mix with and atomize the non-gaseous fuel.

3. The burner of claim 2, wherein the atomizing stream comprises steam.

4. The burner of claim 3, comprising a plurality of non-gaseous fuel guns for supplying non-gaseous fuel.

5. The burner of claim 1, comprising a plurality of non-gaseous fuel guns for supplying non-gaseous fuel.

6. The burner of claim 5, wherein the radial positioning of said non-gaseous fuel guns is sufficient to enable the combustion of the gaseous fuel to enhance non-gaseous fuel vaporization and stabilize non-gaseous fuel combustion.

7. The burner of claim 6, wherein said peripheral tile has a plurality of radially disposed openings for placement of said plurality of non-gaseous fuel guns within said openings of said peripheral tile.

8. The burner of claim 7, further comprising:

(h) at least one passageway having a first end at a second opening in the furnace and a second end adjacent the upstream end of said burner tube, said first end being spaced an effective distance from said first opening for minimizing entrainment of a burner flame into said second opening; and (i) means for drawing flue gas from said furnace through said at least one passageway in response to an inspirating effect created by uncombusted fuel, flowing through said burner tube from its upstream end towards its downstream end.

9. The burner of claim 8, further comprising:

(j) a wall extending into the furnace between a first flame opening and said first end of said at least one passageway to provide a substantial barrier to flow and stabilize each flame.

10. The burner of claim 9, wherein said wall peripherally surrounds said peripheral tile which further surrounds said burner tip.

11. The burner of claim 10, wherein said at least one non-gaseous fuel gun is located radially between an outer diameter of said burner tip and an inner diameter of said wall.

12. The burner of claim 1, wherein said upstream end of said burner tube receives fuel and flue gas, air or mixtures thereof and wherein said burner further comprises:

(g) at least one passageway having a first end at a second opening in the furnace for admitting flue gas and a second end adjacent the upstream end of said burner tube.

13. The burner of claim 1, wherein non-gaseous fuel is supplied to said at least one non-gaseous fuel gun.

14. The burner of claim 1, wherein the non-gaseous fuel is selected from the group consisting of steam cracker tar, catalytic cracker bottoms, vacuum resids, atmospheric resids, deasphalted oils, resins, coker oils, heavy gas oils, shale oils, tar sands or syncrude derived from tar sands, distillation resids, coal oils, asphaltenes, pyolysis fuel oil (PFO), virgin naphthas, cut-naphtha, steam-cracked naphtha, and pentane.

15. The burner of claim 1, wherein the non-gaseous fuel comprises steam cracker tar.

16. The burner of claim 1, wherein said burner further comprises at least one steam injection tube for NOx reduction.

17. The burner of claim 1, wherein combustion of the non-gaseous fuel produces from about 0% to about 50% of the burner's heat release.

18. The burner of claim 1, wherein combustion of the non-gaseous fuel produces from about 0% to about 37% of the burner's heat release.

19. The burner of claim 1, wherein combustion of the non-gaseous fuel produces from about 0% to about 25% of the burner's heat release.

20. A method for combusting a non-gaseous fuel and a gaseous fuel within a staged-air burner of a furnace, comprising the steps of:

(a) combining the gaseous fuel and a first portion of air at a predetermined location;

(b) combusting the gaseous fuel at a first combustion point downstream of said predetermined location to produce a gaseous fuel flame;

(c) providing the non-gaseous fuel to at least one fuel discharge orifice;

(d) discharging a second portion of fresh or ambient combustion air into the furnace through at least one air port;

(e) combusting the non-gaseous fuel downstream of the discharge orifice at a second combustion point to produce a non-gaseous fuel flame; and (f) exchanging heat between the gaseous fuel flame and a portion of the non-gaseous fuel to enhance non-gaseous fuel vaporization and stabilize non-gaseous fuel combustion;

wherein the non-gaseous fuel is provided so as to be radially positioned beyond the first point of combustion so that a flame emanating from the combustion of the non-gaseous fuel is substantially aligned in parallel with a flame emanating from the combustion of the gaseous fuel; and wherein an opening between a peripheral tile and at least one non-gaseous gun providing the non-gaseous fuel is sized to be effective for providing a portion of the air for combustion of the non-gaseous fuel and to prevent incoming air from delaying vaporization of the non-gaseous fuel.

21. The method of claim 20, wherein the non-gaseous fuel comprises liquid fuel.

22. The method of claim 20, wherein the non-gaseous fuel comprises steam cracker tar.

23. The method of claim 22, further comprising the step of:

(g) drawing a stream of flue gas from the furnace in response to the inspirating effect of uncombusted gaseous fuel exiting a gas spud and flowing towards said combustion point, the gaseous fuel mixing with air at the predetermined location upstream of the first point of combustion.

24. The method of claim 23, further comprising the step of:

(h) providing a wall extending into the furnace between a first flame opening and a location within the furnace to provide a substantial barrier to flow and stabilize each flame.

25. The method of claim 24, wherein the wall operates to reduce the amount of oxygen flowing into the base of a flame.

26. The method of claim 24, wherein the furnace is a steam cracking furnace.

27. The method of claim 20, wherein the gaseous fuel is combusted using a premix burner.

28. The method of claim 20, wherein the furnace is a steam cracking furnace.

29. The method of claim 20, wherein further comprising the step of injecting steam for NOx reduction.

30. The method of claim 20, further comprising the step of combusting the non-gaseous fuel and producing from about 0% to about 50% of the burner's heat release.

31. The method of claim 20, further comprising the step of combusting the non-gaseous fuel and producing from about 0% to about 37% of the burner's heat release.

32. The method of claim 20, further comprising the step of combusting the non-gaseous fuel and producing from about 0% to about 25% of the burner's heat release.

* * * * *